US010307774B2

(12) United States Patent
Finkman

(10) Patent No.: US 10,307,774 B2
(45) Date of Patent: Jun. 4, 2019

(54) AUTOMATIC FRAGRANCE DISPENSING

(71) Applicant: Shai Finkman, Haifa (IL)

(72) Inventor: Shai Finkman, Haifa (IL)

( * ) Notice: Subject to any disclaimer, the term of this patent is extended or adjusted under 35 U.S.C. 154(b) by 0 days.

(21) Appl. No.: 15/528,631

(22) PCT Filed: Nov. 19, 2015

(86) PCT No.: PCT/IL2015/051118
§ 371 (c)(1),
(2) Date: May 22, 2017

(87) PCT Pub. No.: WO2016/079744
PCT Pub. Date: May 26, 2016

(65) Prior Publication Data

US 2017/0259282 A1 Sep. 14, 2017

Related U.S. Application Data

(60) Provisional application No. 62/082,150, filed on Nov. 20, 2014.

(51) Int. Cl.

| | |
|---|---|
| ***B05B 7/00*** | (2006.01) |
| ***E03D 9/03*** | (2006.01) |
| ***E03D 5/092*** | (2006.01) |

(52) U.S. Cl.
CPC ..... *B05B 7/0081* (2013.01); *E03D 5/092* (2013.01); *E03D 9/037* (2013.01)

(58) Field of Classification Search
CPC ..... E03D 9/00; E03D 9/02
USPC ..... 4/226.1, 228.1
See application file for complete search history.

(56) References Cited

FOREIGN PATENT DOCUMENTS

JP 2007077785 A * 3/2007

* cited by examiner

*Primary Examiner* — Lauren A Crane
(74) *Attorney, Agent, or Firm* — Browdy and Neimark, PLLC

(57) ABSTRACT

An automatic fragrance dispenser, comprising: a mechanism compartment comprising a water operated actuator fluidically connected between a water supply pipe and a water exit pipe, wherein the propeller turns as a result of water flow through it; and a fragrant substance compartment containing a fragrant substance, wherein turning of the propeller is coupled to dispensing the fragrant substance.

18 Claims, 8 Drawing Sheets

AUTOMATIC FRAGRANCE DISPENSING

FIELD OF THE INVENTION

The present invention relates to fragrance dispensing. More particularly, the present invention relates to automatic fragrance dispensing.

BACKGROUND OF THE INVENTION

There are many available products for dispensing fragrance (e.g. air fresheners) both in private homes and also in public facilities, for instance restrooms in restaurants. These products are typically provided as a spray dispenser, where the user needs to operate the dispenser every time in order to release the fragrance. Such usage of the dispenser is not convenient, especially in public facilities, since the user is required to look for the dispenser and manually operate it. Additionally, as some dispensers have different mechanical operation of the dispensing mechanism, the user wastes some time in figuring out how to operate the fragrance dispenser.

U.S. Pat. No. 5,675,845 describes a fragrance dispensing mechanism, powered by electrical means, that is coupled to the flushing mechanism of a toilet and actuated every time the water level inside the toilet tank drops below a certain level. Such devices require a technician (such as a plumber) to preinstall the fragrance dispenser for each toilet tank. Furthermore, if batteries are present in the device then there is a need for a routine replacement.

There is therefore a need for a fragrance dispensing apparatus that can be easily coupled to a toilet by any user, without the need of tampering with the toilet tank, such that automatic fragrance dispensing is enabled, without any electrical installation or battery replacement.

SUMMARY OF THE INVENTION

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

According to one aspect of the present invention, there is provided an automatic fragrance dispenser, comprising: a mechanism compartment comprising a water operated actuator fluidically connected between a water supply pipe and a water exit pipe, wherein the propeller turns as a result of water flow through it; and a fragrant substance compartment containing a fragrant substance, wherein turning of the propeller is coupled to dispensing the fragrant substance.

According to one embodiment of the present invention, the water operated actuator is a propeller.

According to another embodiment of the present invention, the automatic fragrance dispenser further comprises: an elastic element coupled to the propeller; a nozzle connected to the fragrant substance compartment, and a movable surface positioned between the fragrant substance compartment and the mechanism compartment, adjacent to the elastic element.

According to yet another embodiment of the present invention, the automatic fragrance dispenser further comprises: a gaseous substance compartment, positioned between the mechanism compartment and the fragrant substance compartment, containing a gaseous substance, and comprising: a movable surface positioned between the gaseous substance compartment and the mechanism compartment, adjacent to the elastic element, and a one way valve positioned between the gaseous substance compartment and the fragrant substance compartment, allowing movement of a gaseous substance from the gaseous substance compartment to the fragrant substance compartment, and a nozzle is connected to the fragrant substance compartment.

According to a further embodiment of the present invention, the automatic fragrance dispenser further comprises: a power generator electrically coupled to the propeller; a capacitor having a predetermined capacity electrically coupled to the power generator, and a nozzle connected to the fragrant substance compartment, and operably connected to the capacitor.

According to yet a further embodiment of the present invention, the automatic fragrance dispenser further comprises: a turning element having wing-like structures, pivotally connected to the propeller and contained in the fragrant substance compartment, wherein the fragrance substance is in the form of solid fragments, and at least one wall of the fragrance substance compartment is perforated.

According to another embodiment of the present invention, the water supply source is a shutoff valve of a toilet and the water exit conduit is a water supply line of a toilet.

According to yet another embodiment of the present invention, the water supply source is a water supply line of a toilet and the water exit conduit is a water supply line of a toilet.

According to a further embodiment of the present invention, the water supply source is a water supply line of a faucet and the water exit conduit is a water supply line of a faucet.

According to another embodiment of the present invention, the gaseous substance is air.

According to yet another embodiment of the present invention, the fragrant substance is stored in a replaceable capsule.

According to another aspect of the present invention, there is provided a method for automatically dispensing fragrance, comprising: actuating a water operated actuator, and coupling the actuator to dispense a fragrant substance.

According to one embodiment of the present invention, the method for automatically dispensing fragrance further comprises after turning the propeller by flowing water through the propeller: compressing an elastic member coupled to the propeller by turning the propeller; releasing the elastic element once a predetermined amount of compression is forced onto the elastic element; moving a movable surface positioned adjacent to the elastic member by the release of the elastic member; decreasing the volume of a fragrant substance compartment positioned adjacent to the movable surface by the moving of the movable surface; increasing the pressure in the fragrant substance compartment by decreasing the volume of the fragrant substance compartment, and dispensing an amount of fragrant substance from the fragrant substance compartment through a nozzle connected to the fragrant substance compartment, by increasing the pressure in the fragrant substance compartment.

According to another embodiment of the present invention, the method for automatically dispensing fragrance further comprises after turning the propeller by flowing water through the propeller: compressing an elastic member coupled to the propeller by turning the propeller; releasing the elastic element once a predetermined amount of compression is forced onto the elastic element; moving a movable surface positioned adjacent to the elastic member by the release of the elastic member; decreasing the volume of a gaseous substance compartment positioned adjacent to the movable surface, by the moving of the movable surface; increasing the pressure in the gaseous substance compartment by decreasing the volume of the gaseous substance compartment; pushing an amount of a gaseous substance from the gaseous substance compartment to a fragrant substance compartment positioned adjacent to the gaseous substance compartment through a one way valve positioned between the gaseous substance compartment and the fragrant substance compartment, by increasing the pressure in the gaseous substance compartment; increasing the pressure in the fragrant substance compartment by pushing an amount of gaseous substance from the gaseous substance compartment to the fragrant substance compartment, and dispensing an amount of fragrant substance from the fragrant substance compartment through a nozzle connected to the fragrant substance compartment, by increasing the pressure in the fragrant substance compartment.

According to another embodiment of the present invention, the method for automatically dispensing fragrance further comprises after turning the propeller by flowing water through the propeller: generating an electrical power in a power generator electrically coupled to the propeller by turning the propeller; charging a capacitor having a predetermined capacity and electrically coupled to the power generator with the electrical power generated by the power generator; discharging the capacitor once the amount of the electrical power charged in the capacitor exceeds the predetermined capacity of the capacitor; operating a nozzle operably connected to the capacitor by using the electrical power discharged from the capacitor, and dispensing an amount of fragrant substance from a fragrant substance compartment through the nozzle, which is connected to the fragrant substance compartment, by operating the nozzle.

According to yet another embodiment of the present invention, the method for automatically dispensing fragrance further comprises after turning the propeller by flowing water through the propeller: turning a turning element having wing-like structures, pivotally connected to the propeller and contained in the fragrant substance compartment; causing a collision of solid fragrant substance fragments contained in the fragrant substance compartment by turning the turning element having wing-like structures; dispensing a fragrant substance from the solid fragrant substance fragments by causing the collision of the solid fragrant substance fragments, and dispensing a fragrant substance from the fragrant substance compartment through at least one perforated wall of the fragrant substance compartment.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DETAILED DESCRIPTION OF THE INVENTION

Figure 1:
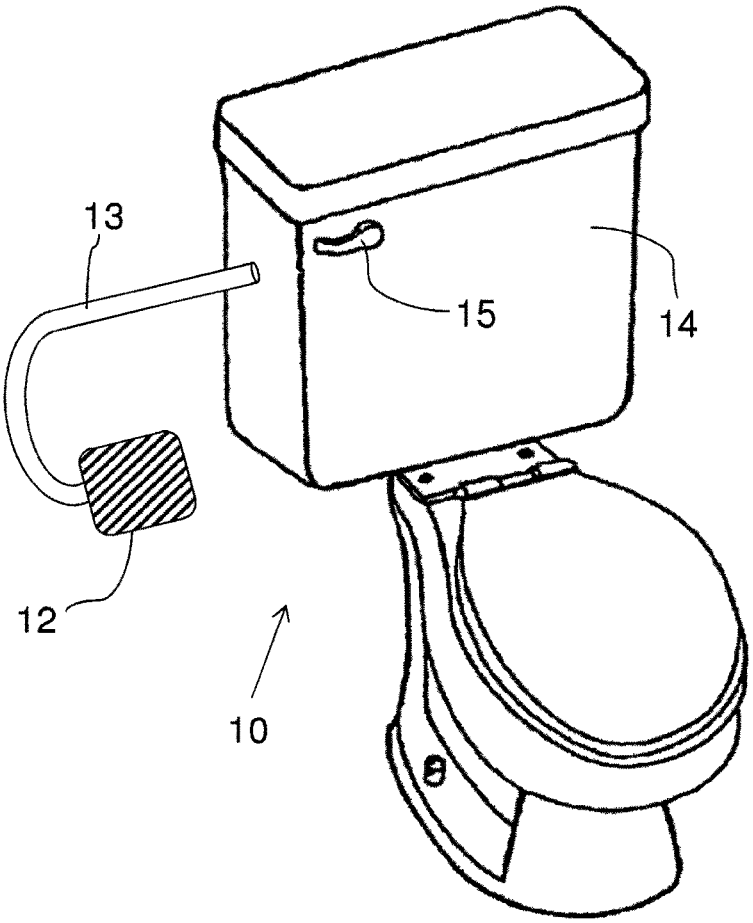
PRIOR ART FIG. 1
FIG. 1 schematically illustrates a commercially available toilet.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

For clarity, non-essential elements were omitted from some of the drawings.

FIG. 1 schematically illustrates a commercially available toilet 10. Each toilet 10 has a water tank 14 with a handle 15, so that flushing of the water tank 14 is actuated by pressing the handle 15. A water supply line 13 provides water to the water tank 14, whereby typically the water supply line 13 has a shutoff valve 12 such that the water supply to each water tank 14 can be stopped using the corresponding shutoff valve 12. It will therefore be advantageous to utilize such existing systems for assembling an automatic fragrance dispenser at the existing connection point between the shutoff valve 12 and the water supply line 13, further described hereinafter.

Figure 2A:
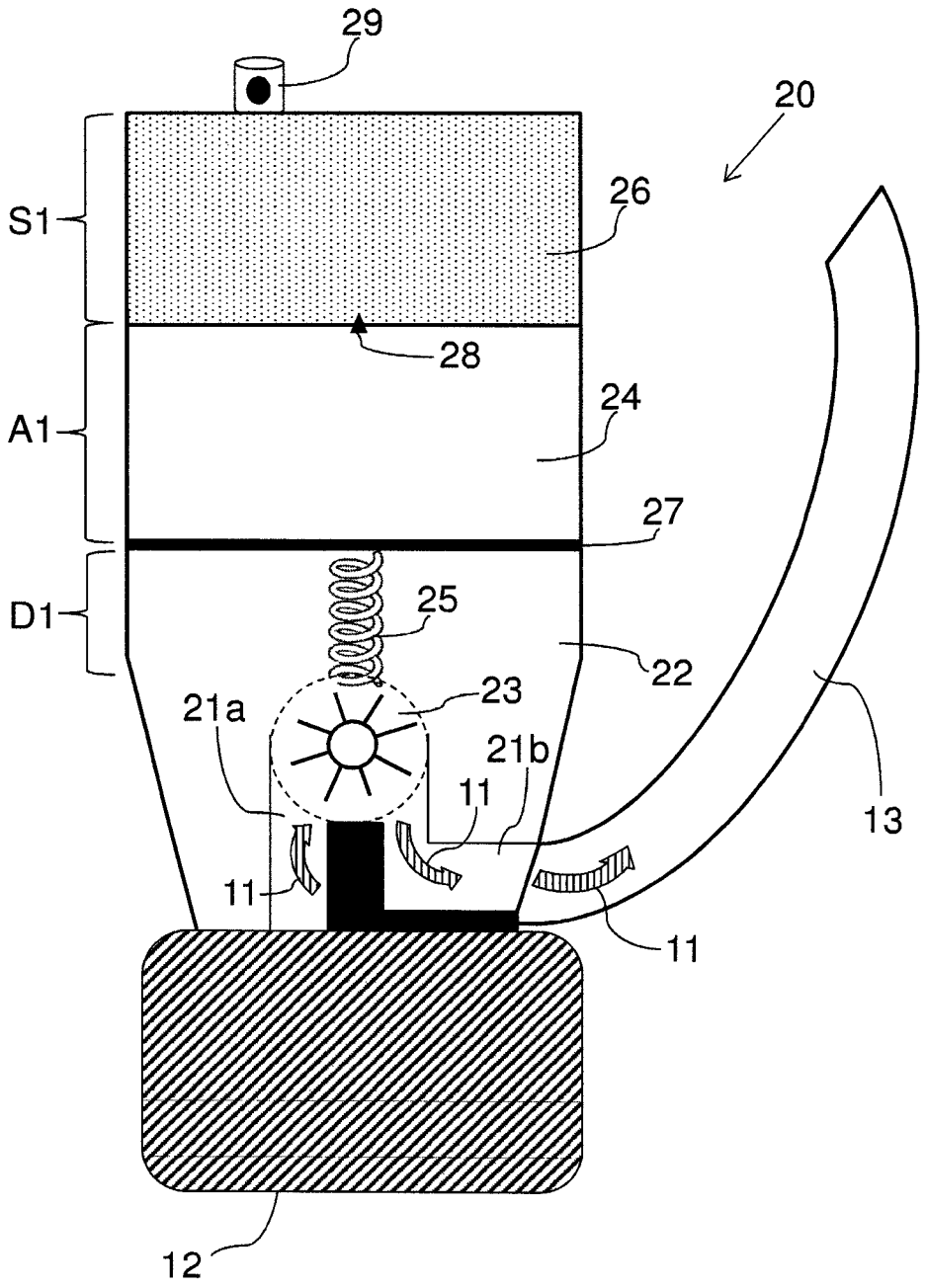
FIG. 2A schematically illustrates a cross-sectional view of an automatic fragrance dispenser connected between the shutoff valve and the water supply line, according to an exemplary embodiment.
Figure 2B:
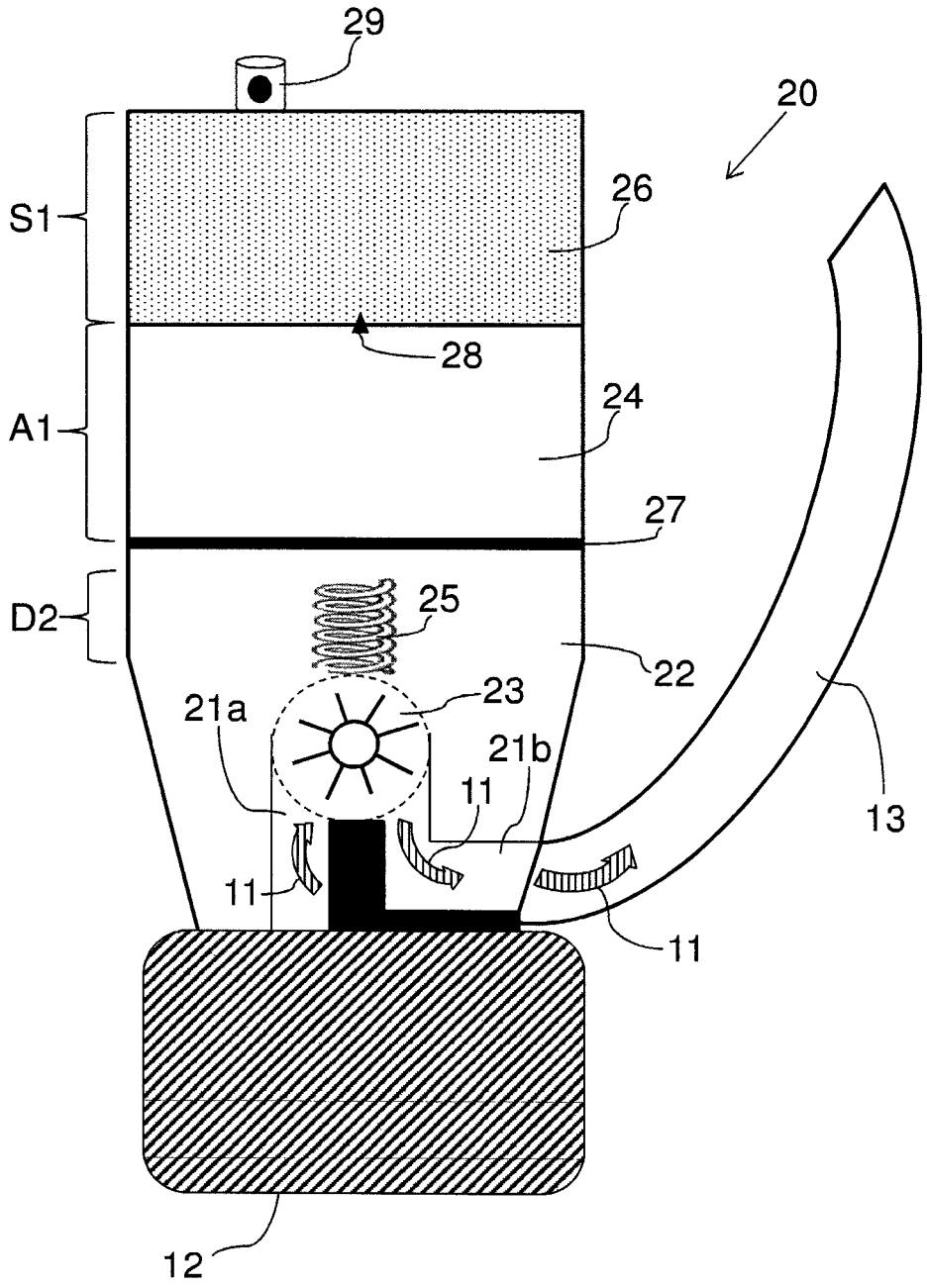
FIG. 2B schematically illustrates a cross-sectional view of the automatic fragrance dispenser with an elastic element in a compressed state.
Figure 2C:
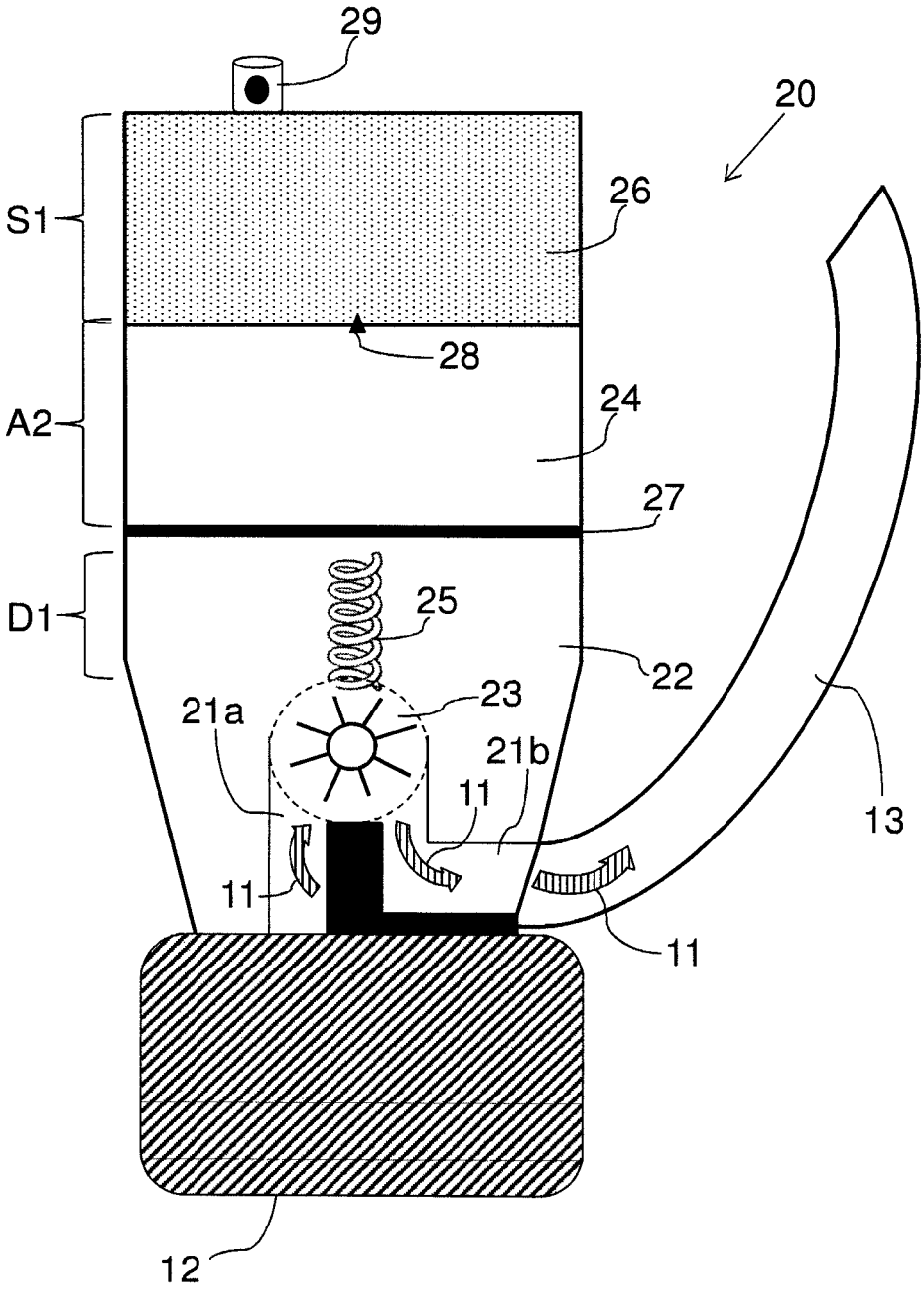
FIG. 2C schematically illustrates a cross-sectional view of the automatic fragrance dispenser 20 with the elastic element 25 in a released state.

Referring now to FIGS. 2A-2C, these figures illustrate different states in the operation of an automatic fragrance dispenser 20. FIG. 2A schematically illustrates a cross-sectional view of an automatic fragrance dispenser 20 connected between the shutoff valve 12 and the water supply line 13. In this configuration, the automatic fragrance dispenser 20 may be easily assembled between the shutoff valve 12 and the water supply line 13 using standard water pipe connections. Thus, any user may assemble the automatic fragrance dispenser 20 without the need of tampering with the water tank 14 (shown in FIG. 1).

The automatic fragrance dispenser 20 comprises three main compartments: a mechanism compartment 22, a gaseous substance compartment 24, and a fragrant substance compartment 26, whereby the gaseous substance compartment 24 is positioned between the mechanism compartment 22 and the fragrant substance compartment 26. The gaseous substance compartment 24 contains a gaseous substance (preferably air) having an initial volume A1, and the fragrant substance compartment 26 contains a fragrant substance (e.g. air freshener, perfume etc.) having an initial volume S1. The gaseous substance from the gaseous substance compartment 24 may enter the volume of the fragrant substance compartment 26 through a one way valve 28, positioned between the gaseous substance compartment 24 and the fragrant substance compartment 26, if a predetermined amount of pressure formed in the gaseous substance compartment 24 pushes the gaseous substance. The fragrant substance compartment 26 is further connected to a nozzle 29 through which the fragrant substance may be dispensed into the surroundings of the toilet (further described hereinafter).

The mechanism compartment 22 comprises a water operable actuator, preferably a propeller, fluidically connected between a water supply pipe 21*a* and a water exit pipe 21*b*, and an elastic element 25. The first portion of the water pipe 21*a* is connected to a water supply source, for example a shutoff valve 12 of a toilet and also connected to the propeller 23, such that water flows (indicated by arrows 11) from the shutoff valve 12 to the propeller 23. The flowing water may turn the propeller 23 and then exit through the second portion of the water pipe 21*b* (indicated by arrows 11). Finally, the water may exit (indicated by arrows 11) the automatic fragrance dispenser 20 through a water exit conduit, for example a water supply line 13 of a toilet, connected to the second portion of the water pipe 21*b*. Optionally, the water may fill the entire mechanism compartment 22 until it exits through the water supply line 13.

It should be noted that water passes through the automatic fragrance dispenser 20 with the sole purpose of rotating the propeller 23, such that normal operation of the toilet 10 (shown in FIG. 1) is undisturbed as the water supply line 13 carries the water from the automatic fragrance dispenser 20 and to the water tank 14.

The elastic element 25, (e.g. a coil spring) is initially at rest having a length D1, prior to a first flushing of the water tank 14 (shown in FIG. 1) with the water flowing through the assembled automatic fragrance dispenser 20. The elastic element 25 is coupled to the propeller 23, whereby this coupling is configured to allow compression of the elastic element 25 due to the rotation of the propeller 23. Such compression of the elastic element 25 may be utilized in order to change the volume of the gaseous substance compartment 24 (further described hereinafter) once the compressed elastic element 25 is released once a predetermined amount of compression is forced onto the elastic element 25.

Additionally, the elastic element 25 is positioned adjacent to a movable surface 27 of the gaseous substance compartment 24. Any movement of the surface 27, for instance caused by a movement of the elastic element 25, may change the inner volume of the gaseous substance compartment 24 and thereby change the pressure inside the gaseous substance compartment 24. Such changes in the elastic element 25 and in the surface 27 are further described in the following figures.

FIG. 2B schematically illustrates a cross-sectional view of the automatic fragrance dispenser 20 with the elastic element 25 in a compressed state. After the first flushing of the toilet, the rotation of the propeller 23 causes the elastic element 25 to compress and have a shorter length D2 proportional to the compression, so that D2<D1. At this state the compressed elastic element 25 is "loaded" such that additional rotation of the propeller 23 may cause the release of the stored energy in the compressed elastic element 25.

It should be noted that the elastic element 25 is configured to allow sufficient compression of the elastic element 25 corresponding to a single flushing of the toilet. Namely, after the first flush the water flow rotates the propeller 23 with a force corresponding to a force sufficient to compress the elastic element 25 from a length D1 (as shown in FIG. 2A) to a length D2 (as shown in FIG. 2B) such that any additional force applied onto the elastic element 25, due to a consequent flushing of the toilet, may release the elastic element 25.

FIG. 2C schematically illustrates a cross-sectional view of the automatic fragrance dispenser 20 with the elastic element 25 in a released state. After an additional flushing of the toilet, the elastic element 25 is released to its length at rest D1 and therefore engages the surface 27. The engagement of the elastic element 25 with the surface 27 causes the gaseous substance in the gaseous substance compartment 24 to compress as the volume of the gaseous substance compartment 24 reduces to A2, so that A2<A1. This change in the volume causes an increased pressure inside the gaseous substance compartment 24. This change in pressure corresponds to a predetermined pressure required to push some of the gaseous substance through the one way valve 28 and into the fragrant substance compartment 26. It should be noted that as the elastic element 25 returns to its resting length, the cycle of compression/releasing repeats itself with every flushing of the toilet.

As some gaseous substance enters the fragrant substance compartment 26, the pressure inside the fragrant substance compartment 26 increases and thereby causing some fragrant substance (now mixed with some of the gaseous substance) to be released from the nozzle 29. In this way, every flushing of the toilet causes some fragrant substance to be dispensed from the automatic fragrance dispenser 20 simply by connecting the automatic fragrance dispenser 20 to the water supply line 13.

In a further embodiment, the fragrant substance compartment may accommodate a replaceable capsule with a fragrant substance to be dispensed into the surroundings of the toilet. With such replaceable capsules, once all fragrant substance in the fragrant substance compartment is used a different capsule may be accommodated inside the automatic fragrance dispenser so that it may be reused. Optionally, different capsules may have different fragrant substances (e.g. providing different smells) so that the smell is chosen according to the requirements of the user.

Figure 3:
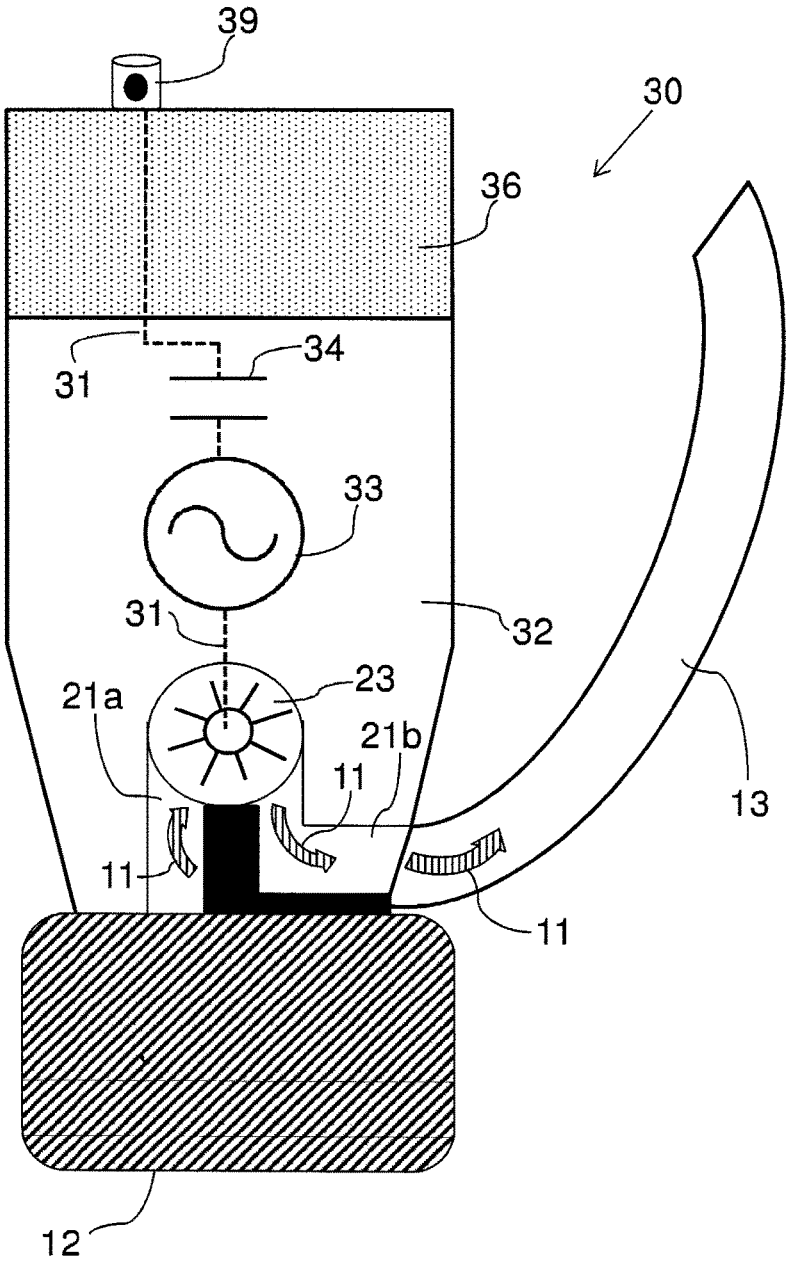
FIG. 3 schematically illustrates a cross-sectional view of an electric automatic fragrance dispenser connected between the shutoff valve and the water supply line, according to an exemplary embodiment.

FIG. 3 schematically illustrates a cross-sectional view of an electric automatic fragrance dispenser 30. In this embodiment instead of an elastic element in the mechanism compartment 32, a propeller 23 is electrically coupled to a power generator 33 with electrical connection wires 31, such that rotation of the propeller 23 generates electrical power. The generated electrical power may be utilized to charge a capacitor 34 having a predetermined capacity.

Once sufficient electrical power is generated (e.g. after a single flushing of the toilet) and thereby fully charging the capacitor 34, the capacitor 34 is discharged as additional electrical power is generated. The discharging of the capacitor 34 may then operate the nozzle 39 with dispensing of a fragrant substance, which is inside the fragrance substance compartment 36. Thus, every flushing of the toilet automatically dispenses some fragrant substance.

Figure 4:
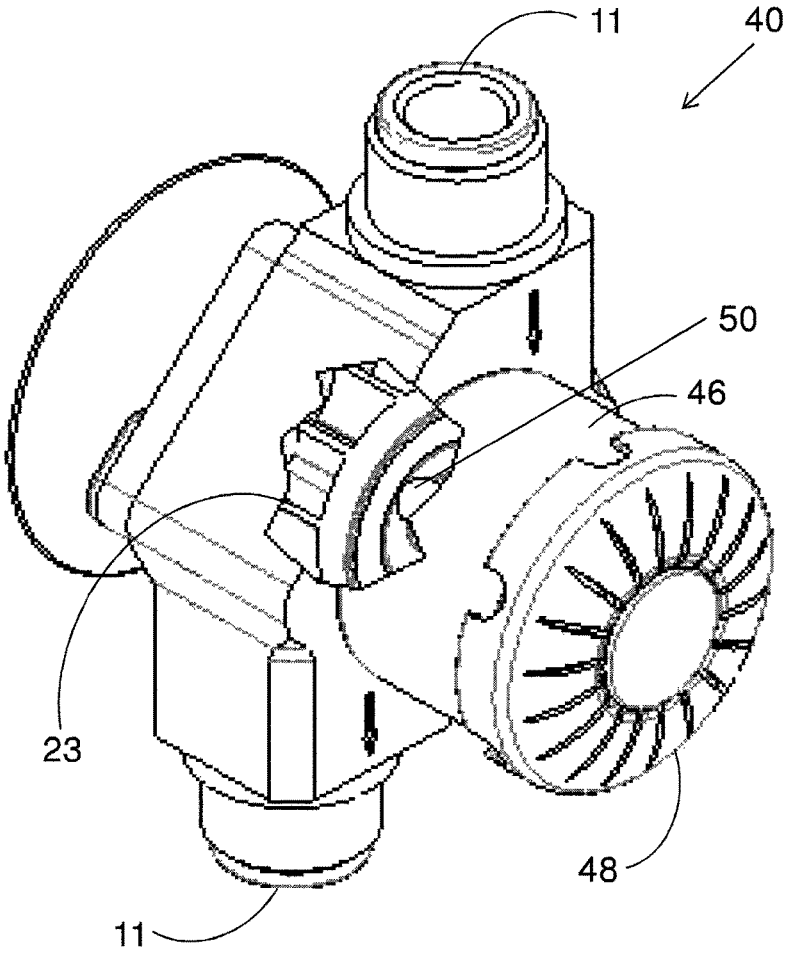
FIG. 4 schematically illustrates a perspective partially broken view of an automatic fragrance dispenser 40, comprising.

FIG. 4 schematically illustrates a perspective partially broken view of an automatic fragrance dispenser 40. In this embodiment, a propeller 23 is pivotally connected to a turning element comprising wing-like structures contained in the fragrant substance compartment 46, in a manner that turning of the propeller 23 induces turning of the turning element comprising wing-like structures. The fragrant substance compartment 46 comprises at least one perforated wall 48. In addition, the fragrant substance compartment 46 contains fragments of a fragrant substance 50 in a solid form, for example in the form of balls. Turning of the turning element with the wing-like elements causes the collision of the solid fragrant substance fragments 50 with each other and with the walls of the fragrant substance compartment 46. This collision induces dispensing of a fragrant substance from the solid fragrant substance fragments 50 to the surroundings through the at least one perforated walls of the fragrant substance compartment 46.

Figure 5A:
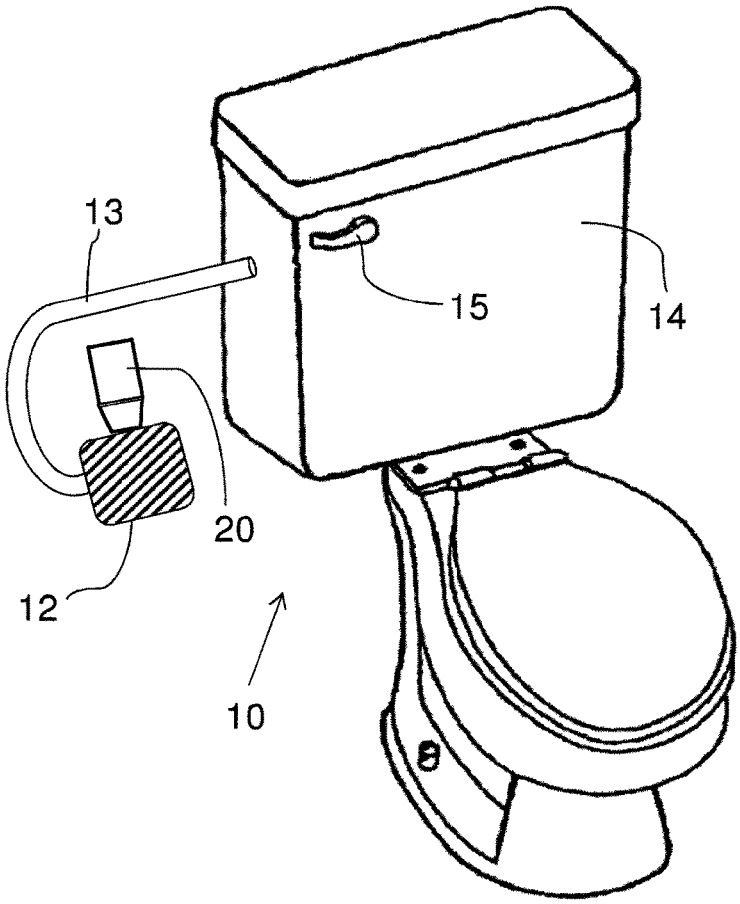
FIG. 5A schematically illustrates the toilet with the automatic fragrance dispenser connected between the shutoff valve and the water supply line, according to an exemplary embodiment.
Figure 5B:
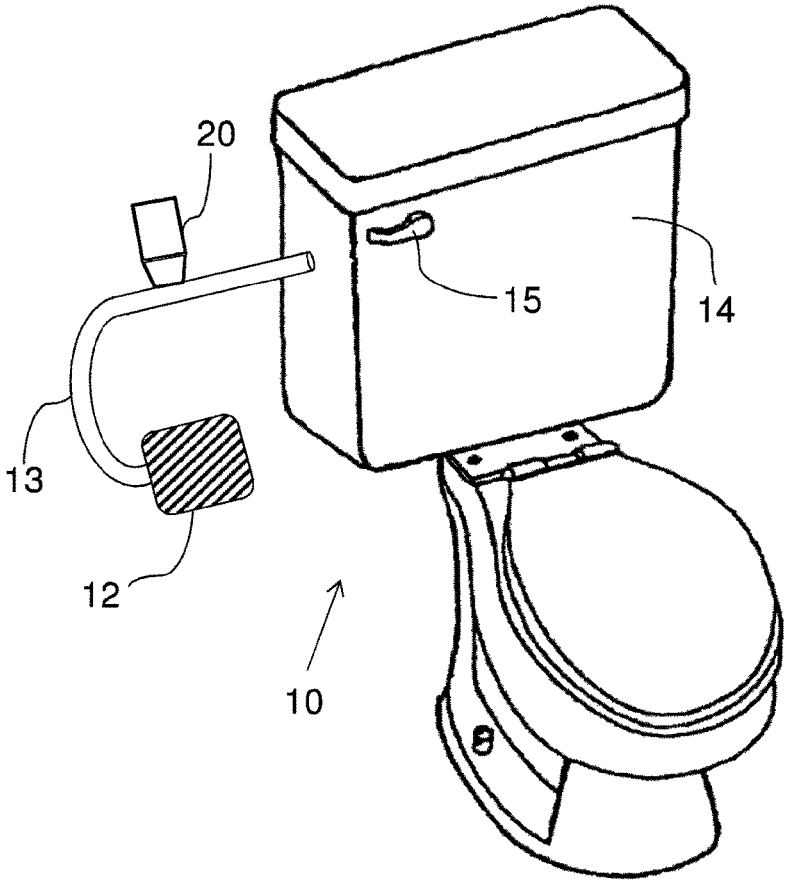
FIG. 5B schematically illustrates the toilet with automatic fragrance dispenser connected directly to the water supply line, according to an exemplary embodiment.

Referring now to FIGS. 5A-5B, these figures illustrate different embodiments for connecting the automatic fragrance dispenser 20 to the water supply line. FIG. 5A schematically illustrates the toilet 10 with the automatic fragrance dispenser 20 connected between the shutoff valve 12 and the water supply line 13.

FIG. 5B schematically illustrates the toilet 10 with automatic fragrance dispenser 20 connected directly to the water supply line 13. In this embodiment, the automatic fragrance dispenser 20 is connected directly to the water supply line 13 with standard water pipe connections (not shown).

In a further embodiment, the automatic fragrance dispenser is connected to a water supply line in a restroom (e.g. connected to a faucet) and not specifically to a toilet. In this embodiment, any flow of water through the automatic fragrance dispenser causes it to dispense a fragrant substance, for instance flow of water initiated by a user washing hands with the faucet.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. An automatic fragrance dispenser, comprising:

a mechanism compartment comprising a water operated actuator fluidically connected between a water supply pipe and a water exit pipe, wherein the water operated actuator is actuated as a result of water flow through it;

a fragrant substance compartment containing a fragrant substance, wherein turning of the water operated actuator is coupled to dispensing the fragrant substance;

an elastic element coupled to the water operated actuator; and a movable surface positioned between the fragrant substance compartment and the mechanism compartment, adjacent to the elastic element.

2. The automatic fragrance dispenser of claim 1, wherein the water operated actuator is a propeller.

3. The automatic fragrance dispenser of claim 1, further comprising:

a gaseous substance compartment containing a gaseous substance positioned between the mechanism compartment and the fragrant substance compartment, and comprising a movable surface positioned between the gaseous substance compartment and the mechanism compartment, adjacent to the elastic element, and a one way valve positioned between the gaseous substance compartment and the fragrant substance compartment, allowing movement of a gaseous substance from the gaseous substance compartment to the fragrant substance compartment, and a nozzle that is connected to the fragrant substance compartment.

4. An automatic fragrance dispenser comprising:

a mechanism compartment comprising a water operated actuator fluidically connected between a water supply pipe and a water exit pipe, wherein the water operated actuator is actuated as a result of water flow through it;

a fragrant substance compartment containing a fragrant substance, wherein turning of the water operated actuator is coupled to dispensing the fragrant substance;

a power generator electrically coupled to the water operated actuator;

a capacitor having a predetermined capacity electrically coupled to the power generator, and a nozzle connected to the fragrant substance compartment, and operably connected to the capacitor.

5. The automatic fragrance dispenser of claim 2, further comprising:

a turning element having wing-like structures, pivotally connected to the propeller and contained in the fragrant substance compartment, wherein the fragrance substance is in the form of solid fragments, and at least one wall of the fragrance substance compartment is perforated.

6. The automatic fragrance dispenser of claim 1, wherein the water supply source is a shutoff valve of a toilet and the water exit conduit is a water supply line of a toilet.

7. The automatic fragrance dispenser of claim 1, wherein the water supply source is a water supply line of a toilet and the water exit conduit is a water supply line of a toilet.

8. The automatic fragrance dispenser of claim 1, wherein the water supply source is a water supply line of a faucet and the water exit conduit is a water supply line of a faucet.

9. The automatic fragrance dispenser of claim 1, wherein the gaseous substance is air.

10. The automatic fragrance dispenser of claim 1, wherein the fragrant substance is stored in a replaceable capsule.

11. A method for automatically dispensing fragrance, comprising:

actuating a water operated actuator;

coupling the actuator to dispense a fragrant -substance;

turning the water operated actuator by flowing water through the water operated actuator;

compressing an elastic member coupled to the water operated actuator by turning the water operated actuator;

releasing the elastic element once a predetermined amount of compression is forced onto the elastic element;

moving a movable surface positioned adjacent to the elastic member by the release of the elastic member;

decreasing the volume of a fragrant substance compartment positioned adjacent to the movable surface by the moving of the movable surface;

increasing the pressure in the fragrant substance compartment by decreasing the volume of the fragrant substance compartment, and dispensing an amount of fragrant substance from the fragrant substance compartment through a nozzle connected to the fragrant substance compartment, by increasing the pressure in the fragrant substance compartment.

12. The method for automatically dispensing fragrance of claim 11, wherein the water operated actuator is a propeller.

13. The method for automatically dispensing fragrance of claim 12, further comprising after turning the propeller by flowing water through the propeller:

compressing an elastic member coupled to the propeller by turning the propeller; releasing the elastic element once a predetermined amount of compression is forced onto the elastic element;

moving a movable surface positioned adjacent to the elastic member by the release of the elastic member;

decreasing the volume of a gaseous substance compartment positioned adjacent to the movable surface, by the moving of the movable surface;

increasing the pressure in the gaseous substance compartment by decreasing the volume of the gaseous substance compartment;

pushing an amount of a gaseous substance from the gaseous substance compartment to a fragrant substance compartment positioned adjacent to the gaseous substance compartment through a one way valve positioned between the gaseous substance compartment and the fragrant substance compartment, by increasing the pressure in the gaseous substance compartment;

increasing the pressure in the fragrant substance compartment by pushing an amount of gaseous substance from the gaseous substance compartment to the fragrant substance compartment, and dispensing an amount of fragrant substance from the fragrant substance 5 compartment through a nozzle connected to the fragrant substance compartment, by increasing the pressure in the fragrant substance compartment.

14. The method for automatically dispensing fragrance of claim 12, further comprising after turning the propeller by flowing water through the propeller:

generating an electrical power in a power generator mechanically coupled to the propeller by turning the propeller;

charging a capacitor having a predetermined capacity and electrically coupled to the power generator with the electrical power generated by the power generator; discharging the capacitor once the amount of the electrical power charged in the capacitor exceeds the predetermined capacity of the capacitor;

operating a nozzle operably connected to the capacitor by using the electrical power discharged from the capacitor, and dispensing an amount of fragrant substance from a fragrant substance compartment through the nozzle, which is connected to the fragrant substance compartment, by operating the nozzle.

15. The method for automatically dispensing fragrance of claim 12, further comprising after turning the propeller by flowing water through the propeller:

turning a turning element having wing-like structures, pivotally connected to the propeller and contained in the fragrant substance compartment;

causing a collision of solid fragrant substance fragments contained in the fragrant substance compartment by turning the turning element having wing-like structures;

dispensing a fragrant substance from the solid fragrant substance fragments by causing the collision of the solid fragrant substance fragments, and dispensing a fragrant substance from the fragrant substance compartment through at least one perforated wall of the fragrant substance compartment.

16. The method for automatically dispensing fragrance according to claim 12, wherein the water flowing through the propeller arrives from a shutoff valve of a toilet and exits to a supply line of a toilet.

17. The method for automatically dispensing fragrance according to claim 12, wherein the water flowing through the propeller arrives from a water supply line of a faucet and exits to a water supply line of a faucet.

18. The method for automatically dispensing fragrance according to claim 13, wherein the gaseous substance is air.

* * * * *